US007841877B1

(12) United States Patent
Lai

(10) Patent No.: US 7,841,877 B1
(45) Date of Patent: Nov. 30, 2010

(54) SOCKET UNIT WITH A ROTATING COVER WITH THREE SLOTS AND A CENTRAL PROTRUDING UNIT WITH A SPRING

(76) Inventor: Li-Chun Lai, 21F-1, No. 33, Sec. 1, Minsheng Rd., Panciao City, Taipei County (TW)

( * ) Notice: Subject to any disclaimer, the term of this patent is extended or adjusted under 35 U.S.C. 154(b) by 0 days.

(21) Appl. No.: 12/729,164

(22) Filed: Mar. 22, 2010

(51) Int. Cl.
*H01R 13/44* (2006.01)

(52) U.S. Cl. ..... 439/145

(58) Field of Classification Search ..... 439/145, 439/139, 142, 346
See application file for complete search history.

(56) References Cited

U.S. PATENT DOCUMENTS 6,984,139 B1 * 1/2006 Lai ..... 439/142
7,156,682 B1 * 1/2007 Lai ..... 439/346
7,275,942 B1 * 10/2007 Wu ..... 439/145
7,695,293 B1 * 4/2010 Sikes ..... 439/139

OTHER PUBLICATIONS

Qingfen Wang et al. "Ultra-Shallow Junction Formation Using Silicide as a Diffusion source and Low thermal Budget", IEEE transactions on electron devices, vol. 39, No. 11 Nov. 1992; p. 2486-2496.

H. Okabayashi, et al.; "Low Resistance MOS Technology Using Self-Aligned Refractory-Silicidation"; Microelectronics Research Labs., Nippon Electronic CO., Ltd. Miyamae-Ku, Kawasaki 213 Japan; IEEE; Page from IEDM-82-556 to IEDM-882-560.

* cited by examiner

*Primary Examiner*—Chandrika Prasad
(74) *Attorney, Agent, or Firm*—Chun-Ming Shih

(57) ABSTRACT

A socket unit includes a main body, a rotational cover and a spring. The main body has a circular indented region, which is provided with three slots. In assembly, a protruding unit is connected with the circular indented region. The rotational cover can fully cover the three slots. The rotational cover has three slots and whose sizes are slightly larger than or substantially equal to those of the slots of the main body. The spring is fitted onto the protruding unit of the rotational cover. The inner end of the spring is fixedly fitted onto the circular indented region and the outer end of the spring is fixedly fitted onto the protruding unit. In use, the prongs of the plug is inserted and the rotational cover is rotated so that the three slots of the rotational cover may line up with the three slots of the main body to allow the three prongs of the plug to reach the three slots. When the plug is unplugged, the rotational cover can fully close the three slots through the returning force of the spring.

6 Claims, 8 Drawing Sheets

SOCKET UNIT WITH A ROTATING COVER WITH THREE SLOTS AND A CENTRAL PROTRUDING UNIT WITH A SPRING

BACKGROUND OF THE INVENTION

1. Field of the Invention

The invention generally relates to a socket unit. More particularly, the invention relates to a socket unit that has a rotational cover to prevent electric shocks.

2. Description of the Prior Art

U.S. Pat. No. 6,984,139 discloses a protective cover for socket. A rotational cover is connected with the main body. The rotational cover may be rotated. Two slots are provided with the rotational cover to allow the insertion of the plug. When the device is not in use, a user may manually rotate the rotational cover for a certain angle so that the rotational cover can cover the sockets of the main body to keep foreign objects and wet objects out of the slots so that short circuits and electric shocks may be prevented. Therefore, safety may be enhanced.

However, the drawback is that a user has to manually rotate the rotational cover. Therefore, improvement is needed.

To eliminate the disadvantage of the aforementioned case, the inventor has put a lot of effort into the subject and has successfully come up with the improved socket unit of the present invention.

SUMMARY OF THE INVENTION

An object of the present invention is to provide a socket unit that has a rotational cover which can fully cover the three slots of the electric source when the unit is not in use to keep foreign objects and wet objects out of the slots so that electric shocks and short circuits may be prevented.

Another object of the present invention is to provide a socket unit that can prevent the accidental contact of a child so as to enhance safety.

To reach these objects, the socket unit of the present invention is disclosed, which comprises a main body, a rotational cover and a spring. The main body 1 has a flat surface and a circular indented region is disposed in the surface. Three slots are provided in the indented region. A hole is centrally provided in the circular indented region. The hole has an arc-shaped position-limiting slot and a positioning hole. The rotational cover can fully cover the three slots. The rotational cover has three slots whose sizes are the same to those of the slots of the main body. A protruding unit is centrally provided on the bottom surface of the rotational cover. A sliding portion is disposed near the outer end of the protruding unit. A positioning slot is provided by the sliding portion. The spring has two ends and is fitted onto the protruding unit of the rotational cover. The outer connective portion of the spring is fixedly held in a positioning slot of the rotational cover. In assembly, the protruding unit is inserted into the hole of the indented region so that the rotational cover may fully cover the three slots of the main body. Now, the rotational cover can rotate around in the circular indented region. The sliding portion engages with the position-limiting slot and the range of motion of the rotational cover is limited by the length of the position-limiting slot. When the unit of the present invention is in use, the plug is inserted into the three slots of the main body after the rotational cover is rotated by the spring and the three slots the rotational cover are aligned with the three slots of the main body. When the plug is unplugged, the returning force of the spring makes the rotational cover fully cover the three slots to keep foreign objects and wet objects out of the slots so that short circuits and electric shocks may be prevented. Therefore, safety is greatly enhanced.

These features and advantages of the present invention will be fully understood and appreciated from the following detailed description of the accompanying Drawings.

DETAILED DESCRIPTION OF THE PREFERRED EMBODIMENTS

Figure 1A:
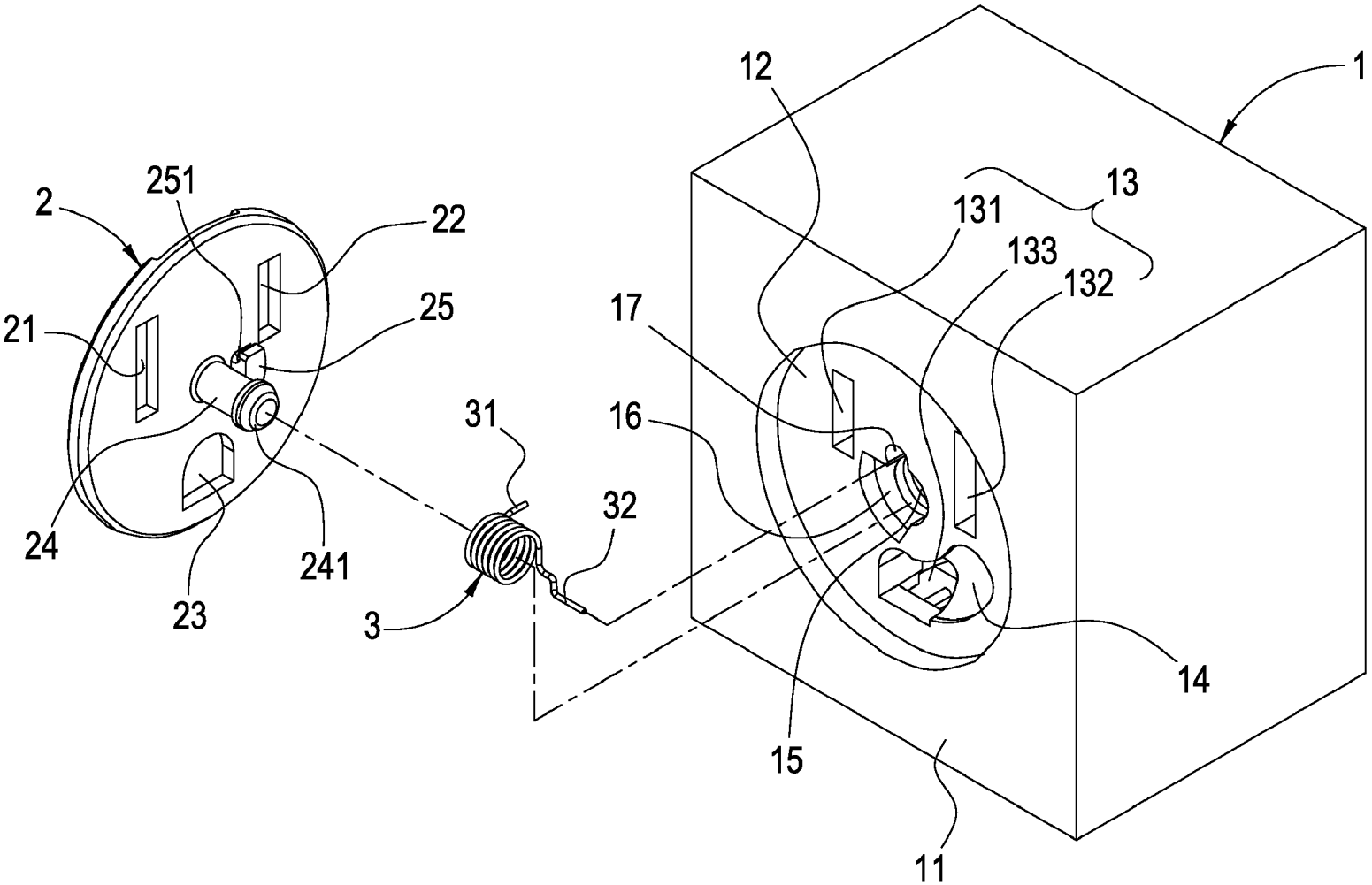
FIGS. 1A, 1B and 1C are three perspective views illustrating the structure of the device the present invention.
Figure 1B:
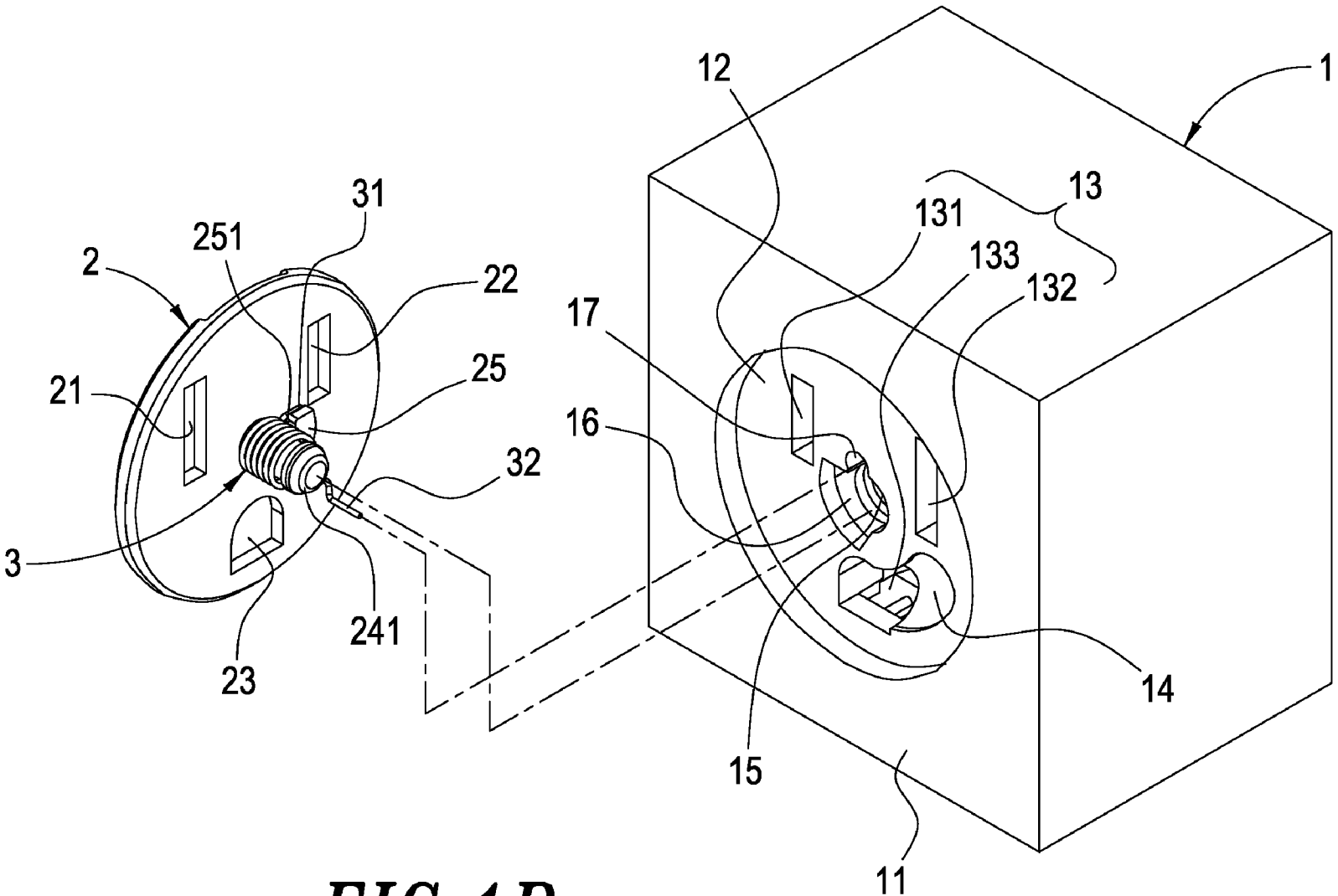
Figure 1C:
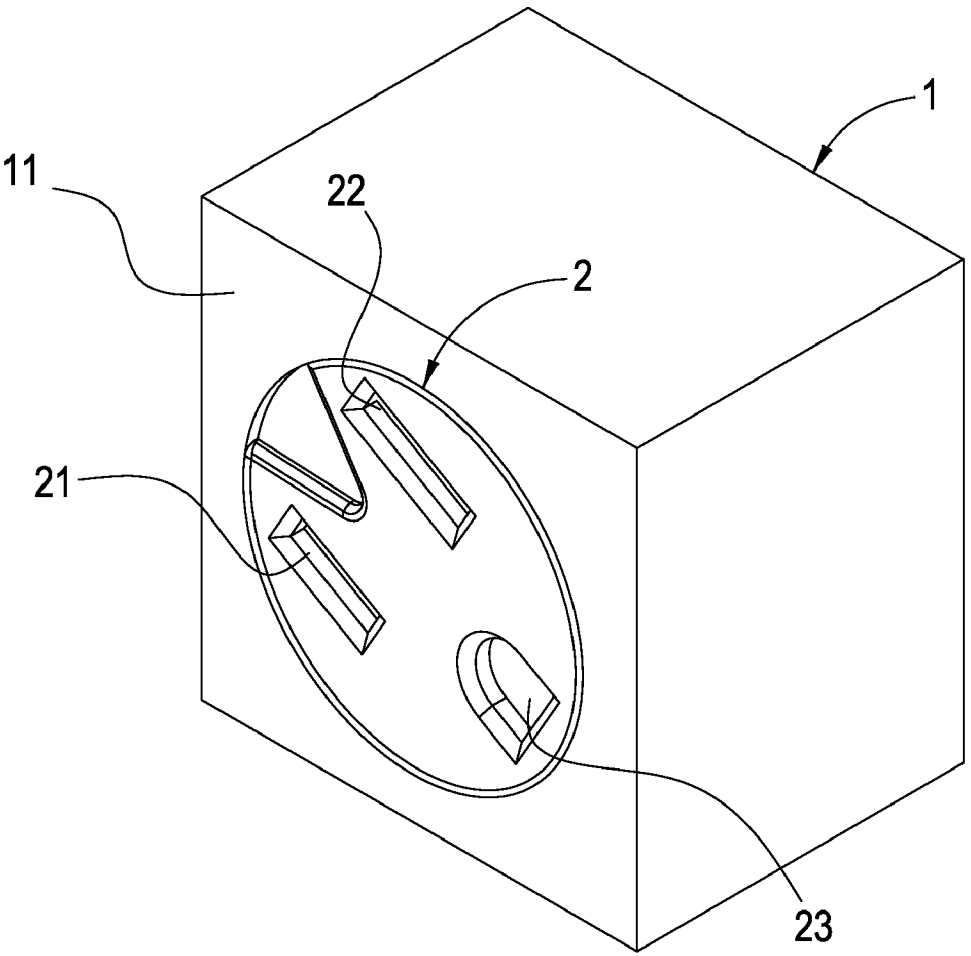

Please see FIGS. 1 to 3. The socket unit of the present invention comprises a main body 1, a rotational cover 2 and a spring 3. The main body 1 has a flat surface 11 and a circular indented region 12 is disposed in the surface 11. Three slots 13 are provided in the indented region 12 and include a first slot 131 (for the positive slot), a second slot 132 (for the negative slot) and a third slot 133 (for the grounding slot). The third slot 133 is connected with an arc-shaped slot. A hole 15 is centrally provided in the circular indented region 12. The hole 15 has an arc-shaped position-limiting slot 16 and a positioning hole 17.

There are three slots 21, 22 and 23 disposed in the rotational cover 2. The sizes of these slots 21, 22 and 23 are slightly larger than or substantially equal to those of the slots 131, 132 and 133. A protruding unit 24 is centrally provided on the inner surface of the rotational cover 2. A cone-shaped connective portion 241 is provided on the inner end of the protruding unit 24. A sliding portion 25 is disposed near the outer end of the protruding unit 24 and its size is smaller than that of the arc-shaped position-limiting slot 16.

Either end of the spring 3 has a connective portion 31 and 32. The spring 3 is fitted onto the protruding unit 24 so that the front end of the spring 3 presses against the inner surface of the rotational cover 2 and the front positioning portion 31 is secured in the sliding slot 251 (as shown in FIG. 1B).

In assembly, the protruding unit 24 is inserted into the hole 15 of the indented region 12 so that the cone-shaped connective portion 241 may engage with the hole 15. The connective portion 32 may be inserted into the positioning hole 17 to fix the connective portion 32. Therefore, the rotational cover 2 can fully cover the three slots 13. Also, the rotational cover 2 may be rotated around the protruding unit 24. The sliding portion 25 may engage with the arc-shaped position-limiting slot 16 and the cone-shaped connective portion 241 may engage with the hole 15. As the rotational cover 2 is rotated, the sliding portion 25 moves along with it in the arc-shaped position-limiting slot 16; as the sliding portion 25 reaches the other wall, the rotational cover 2 is stopped. Therefore, the range of rotation is limited by the length of the position-limiting slot 16.

Figure 2A:
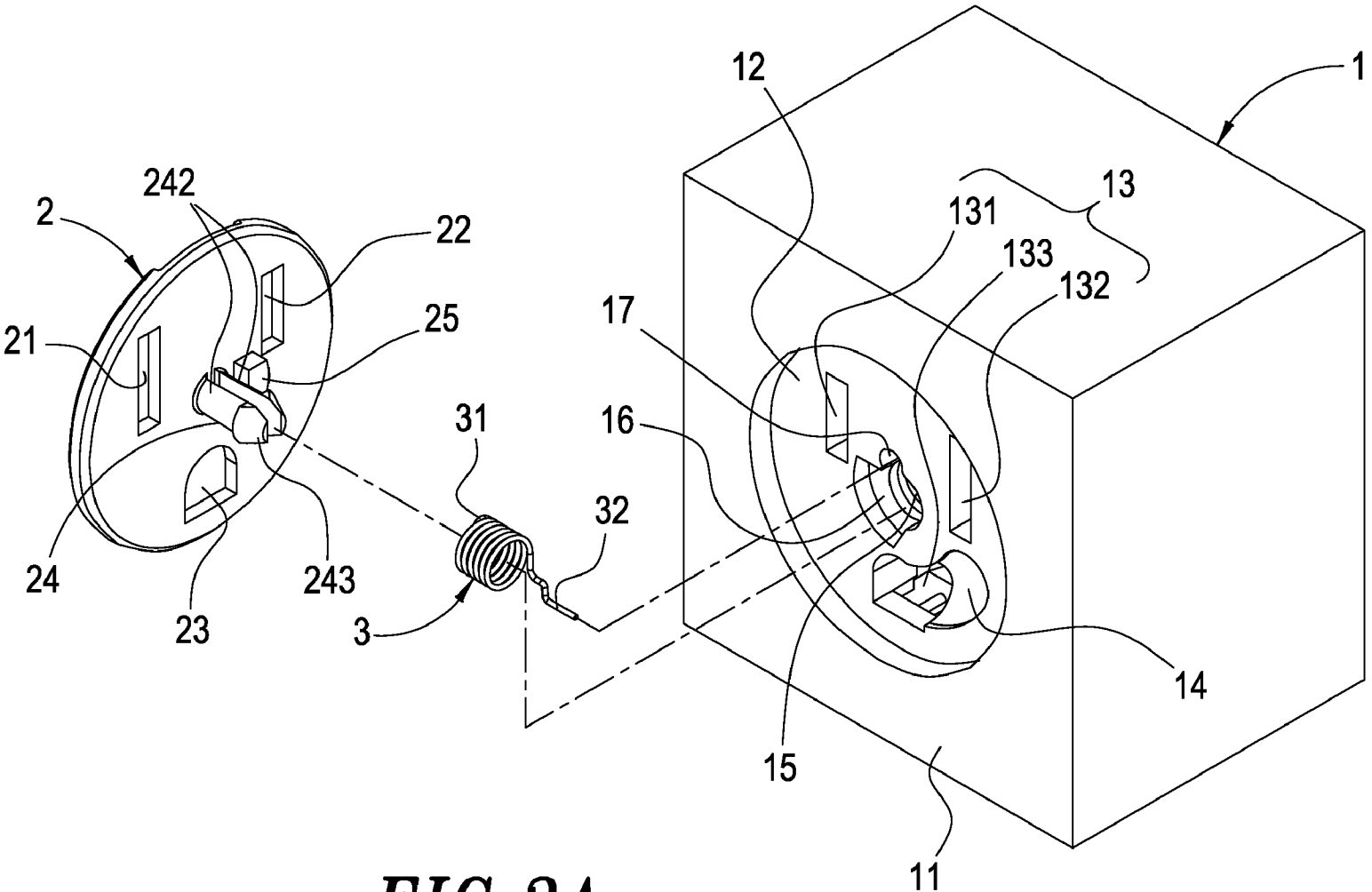
FIGS. 2A and 2B are two perspective views illustrating a second embodiment of the present invention.
Figure 2B:
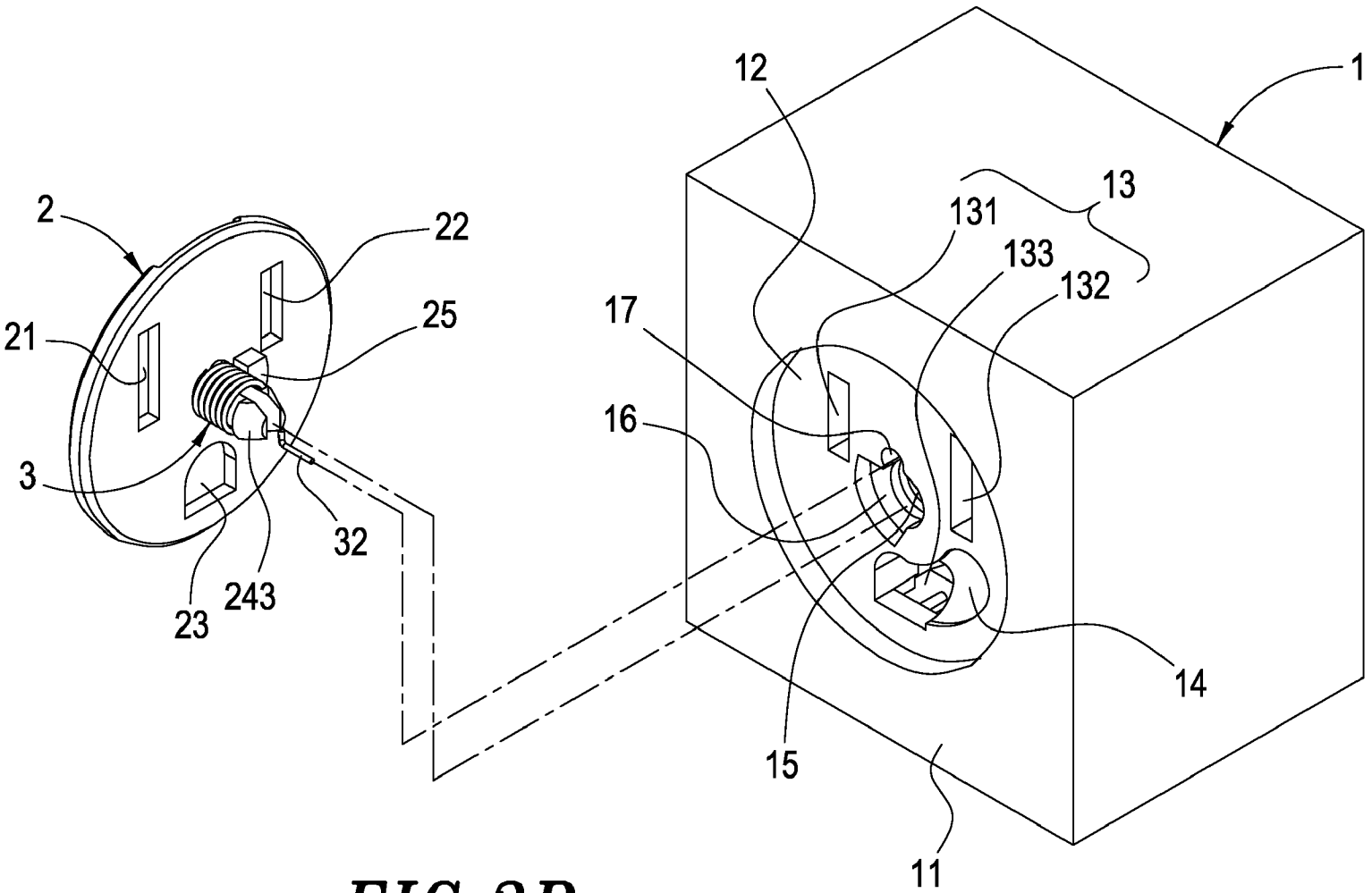

Please refer to FIGS. 2A and 2B, which illustrate another embodiment of the unit of the present invention. The difference between the first embodiment and the second embodiment is the fact that the protruding unit 24 of the latter is consisted of two protruding portions 242. Two connective parts 243 are provided on the rear end of the protruding portions 242. Therefore, when the spring 3 is fitted onto the protruding unit 24, the positioning part 31 is fixedly held between the two protruding portions 242 and there is no need for the sliding slot 251.

In addition, the rotational cover 2 and the indented region 12 may be circular.

Figure 3A:
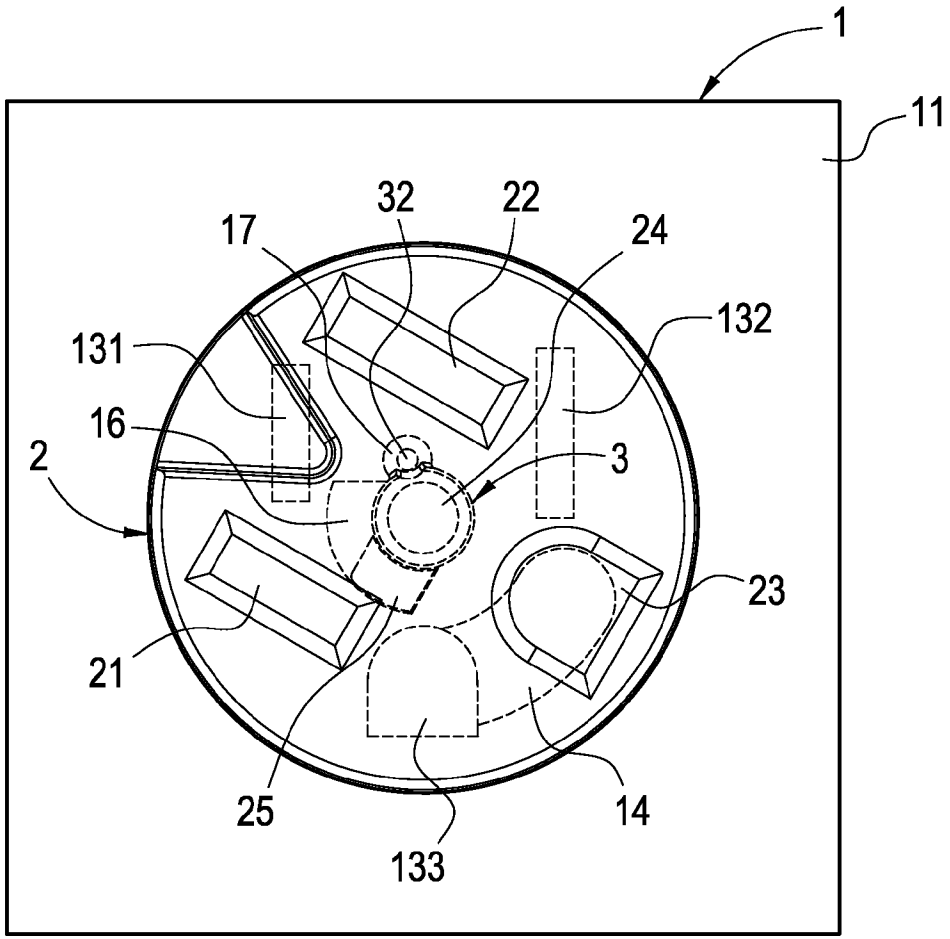
FIGS. 3A, 3B and 3C are three perspective views illustrating the device the present invention in use.
Figure 3A:
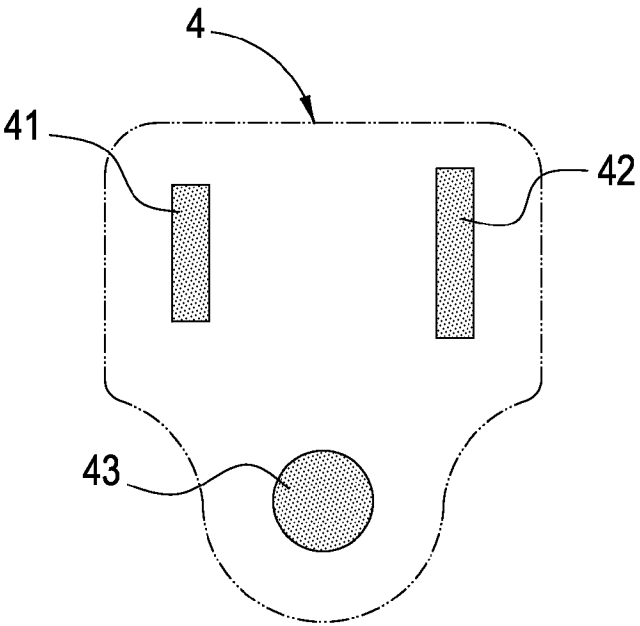
Figure 3B:
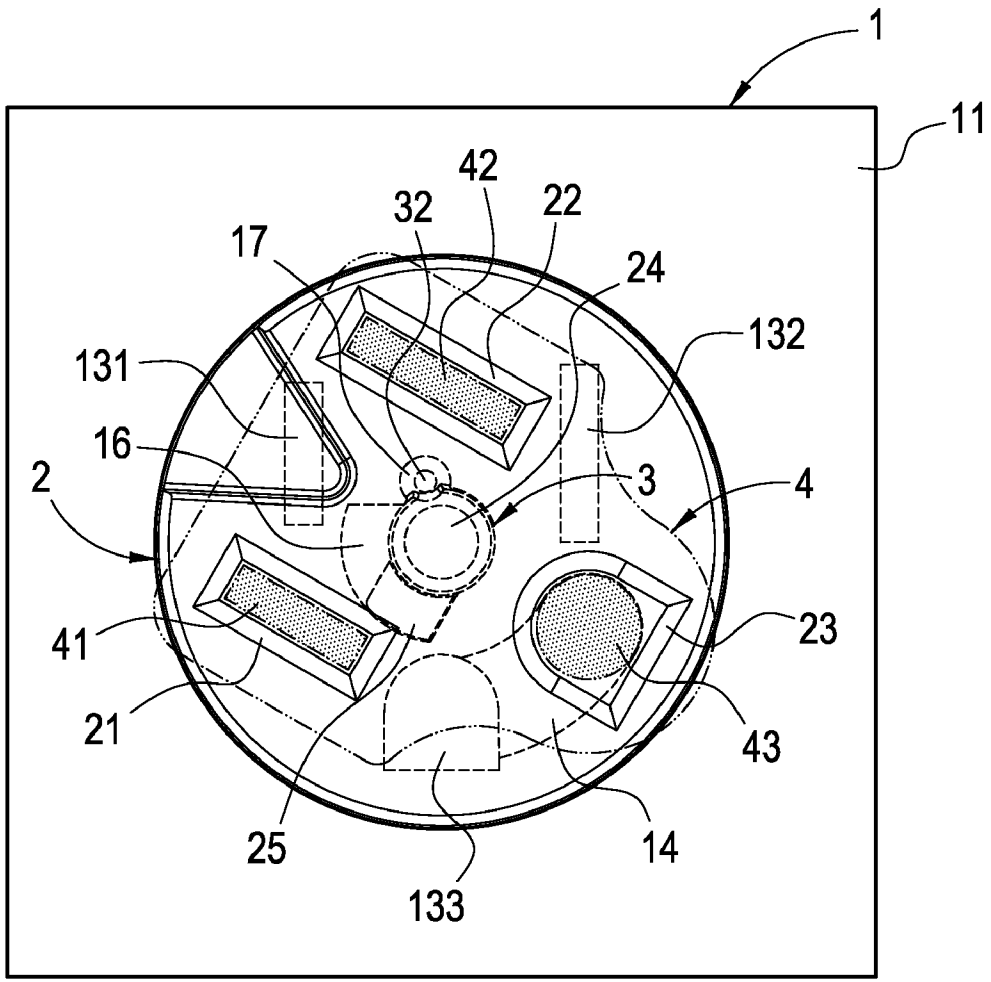
Figure 3C:
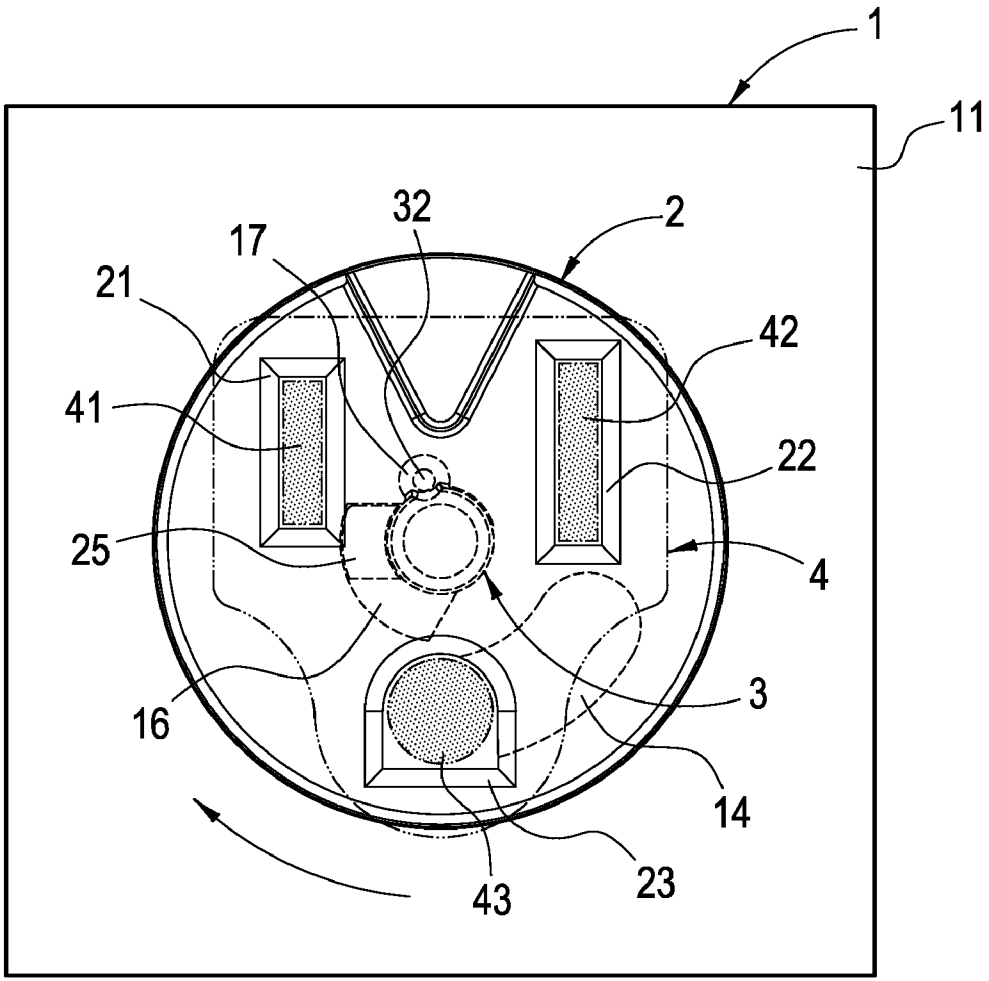

Please see FIGS. 3A and 3B, which illustrate the unit of the present invention in use. When the unit of the present invention is not in use, the rotational cover 2 can fully cover the three slots 131, 132 and 133 to keep foreign objects and wet objects out of the slots 13 so that short circuit and electric shock may be prevented. When the unit of the present invention is in use, three prongs 41, 42 and 43 of an electric plug 4 are inserted into the three slots 21, 22 and 23 of the rotational cover 2. The longer grounding prong 43 of the electric plug 4 may be held in the arc-shaped slot 14. The plug may move the rotational cover 2 (the prong 43 may move in the arc-shaped slot 14 until it is aligned with the slot 133). Now, the spring 3 produces a returning force by the rotational cover 2 and the sliding portion 25 is stopped by the other wall. Therefore, the three slots 21, 22 and 23 of the rotational cover 2 can be aligned up with the three slots 131, 132 and 133 of the main body (the positive slot, negative slot and grounding slot) to allow the three prongs 41, 42 and 43 of the plug to be inserted into the three slots 131, 132 and 133, respectively. When the plug 4 is unplugged, the returning force of the spring 3 makes the rotational cover 2 fully cover the three slots 13.

In comparison with the aforementioned patent case, the unit of the present invention has the following advantages:

1. In the unit of the present invention, the rotational cover 2 can fully cover the three slots 13 when the unit of the present invention is not in use to keep foreign objects and wet objects out of the slots 13 so that electric shocks may be prevented.

2. The unit of the present invention can prevent the accidental contact of children's body with the three slots 13 so that electric shocks may be prevented.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A socket unit, comprising:

a main body, having a circular indented region, which is provided with three first slots, wherein a hole is centrally provided in the circular indented region and the hole has an arc-shaped position-limiting slot and a positioning hole;

a rotational cover, having three second slots and, whose sizes are slightly larger than or substantially equal to the first slots of the main body, wherein a protruding unit is centrally provided on bottom surface of the rotational cover, a cone-shaped connective portion is provided on inner end of the protruding unit and a sliding portion is disposed near outer end of the protruding unit; and a spring, wherein either end of the spring has a connective portion and wherein the spring is fitted onto the protruding unit of the rotational cover so that outer connective portion of the spring may be secured in the rotational cover, whereby, in assembly, the protruding unit is inserted into the hole of the indented region so that the cone-shaped connective portion may engage with the inner wall of the hole, wherein the rotational cover rotates around the protruding unit to line up with the three second slots of the rotational cover with the three first slots of the main body.

2. The socket unit as in claim 1, wherein the three first slots of the main body are a positive slot, a negative slot and a grounding slot, respectively, and the grounding slot is connected with an arc-shaped slot.

3. The socket unit as in claim 1, wherein the rotational cover has three third slots and, whose sizes are slightly larger than or substantially equal to those of the first slots of the main body.

4. The socket unit as in claim 1, wherein a positioning slot is provided by the sliding portion of the rotational cover to secure the outer connective portion of the spring.

5. The socket unit as in claim 1, wherein the protruding unit has two protruding portions and two connective parts are provided on inner ends of the protruding portions so that the positioning part is fixedly held between the two protruding portions.

6. The improved socket unit as in claim 1, wherein the indented region and rotational cover are circular.

* * * * *